US011702884B2

(12) United States Patent
Daniels et al.

(10) Patent No.: US 11,702,884 B2
(45) Date of Patent: Jul. 18, 2023

(54) SECURE PACKAGE DOOR CASING

(71) Applicants: Laron Anthony Daniels, Lawrence, KS (US); Kimberly Diane Daniels, Lawrence, KS (US)

(72) Inventors: Laron Anthony Daniels, Lawrence, KS (US); Kimberly Diane Daniels, Lawrence, KS (US)

( * ) Notice: Subject to any disclaimer, the term of this patent is extended or adjusted under 35 U.S.C. 154(b) by 0 days.

(21) Appl. No.: 17/329,143

(22) Filed: May 25, 2021

(65) Prior Publication Data

US 2021/0363816 A1 Nov. 25, 2021

Related U.S. Application Data

(60) Provisional application No. 63/029,602, filed on May 25, 2020.

(51) Int. Cl.
*E06B 7/32* (2006.01)
*E06B 7/34* (2006.01)

(52) U.S. Cl.
CPC . *E06B 7/32* (2013.01); *E06B 7/34* (2013.01)

(58) Field of Classification Search
CPC ..... E06B 7/32; E06B 7/34
USPC ..... 49/169
See application file for complete search history.

(56) References Cited

U.S. PATENT DOCUMENTS 5,205,224 A * 4/1993 Durst ..... E05G 7/008 109/66
5,581,940 A * 12/1996 Peterson ..... E06B 7/32 49/386
6,588,655 B2 * 7/2003 Stapleton, Jr. ..... E06B 7/34 232/44
7,984,695 B1 * 7/2011 Shaffer ..... E06B 7/32 119/501
10,352,094 B1 * 7/2019 Lopez-Isa ..... A47B 96/06
10,709,106 B2 * 7/2020 Dix ..... E06B 7/32
10,743,693 B2 * 8/2020 Newcomb ..... E06B 7/32
(Continued)

FOREIGN PATENT DOCUMENTS

DE 3245875 A1 * 12/1982
FR 2478987 A1 * 10/1981 ..... A47G 29/124
(Continued)

OTHER PUBLICATIONS

Machine translation of DE3245875A1.*
Machine translation of FR2478987A1.*

*Primary Examiner* — Marcus Menezes

(57) ABSTRACT

A structured casing built within an exterior door in an exterior doorway. The casing comprises of an access tray with a handle and an inner tray flap on the inside of the enclosed casing that are connected by an assembled bracket system, an access door with a handle and a locking device on the interior back, opposing interior and exterior side panels, an interior and exterior casing top, and a casing bottom. Opening the access tray sets the assembled bracket system in motion causing the inner tray flap to position at a 90-degree angle, forming a flat package receiving space. Closing the access tray further sets the assembled bracket system in motion causing the inner tray flap to return to its starting position releasing the package to the bottom where the package can then be retrieved by unlocking and opening the access door from inside a home or building.

12 Claims, 6 Drawing Sheets

(56) References Cited

U.S. PATENT DOCUMENTS

| | | | | |
|---|---|---|---|---|
| 11,399,648 | B2 * | 8/2022 | Lewis | A47G 29/22 |
| 2003/0094485 | A1 * | 5/2003 | Stapleton, Jr. | E06B 7/32 232/19 |
| 2005/0161000 | A1 * | 7/2005 | Noyes | A01K 1/035 119/484 |
| 2014/0190081 | A1 * | 7/2014 | Wanjohi | A47G 29/126 49/504 |
| 2018/0228310 | A1 * | 8/2018 | Enobakhare | A47G 29/20 |
| 2020/0308903 | A1 * | 10/2020 | Anderson | E05F 15/76 |
| 2021/0005033 | A1 * | 1/2021 | Roman | G06Q 10/0833 |
| 2022/0031105 | A1 * | 2/2022 | Newcomb | G06Q 10/0833 |
| 2022/0232798 | A1 * | 7/2022 | Dix | A01K 1/035 |
| 2022/0333436 | A1 * | 10/2022 | Song | A61B 50/30 |

FOREIGN PATENT DOCUMENTS

| | | | | |
|---|---|---|---|---|
| FR | 2811211 | A1 * | 1/2002 | A47G 29/141 |
| GB | 2366597 | A * | 3/2002 | A47G 29/14 |

* cited by examiner

SECURE PACKAGE DOOR CASING

BACKGROUND OF INVENTION

The growing rate of online shopping increases the amount of packages being delivered. While online shopping is a great convenience, packages are delivered and left outside on porches and entryways where they are unsecure and can be stolen. In 2020 e-commerce was an estimated $791 billion and an estimated $7 billion was lost in stolen packages.

With the rise in porch piracy, there have been many attempts to eliminate the problem. Most of the attempts require the installation of some type of complicated technology, retrieving a package from a location other than the delivery address, a device that exposes the inside of a home or a garage, or a box sitting outside of a home taking up porch space.

U.S. Pat. No. 9,596,952 to Carl Joseph Mencel (2017) shows a parcel receptacle with a locking lid and a securing device to secure the receptacle to the door. The securing device is attached to the receptacle on one end and the other end includes an abutment which when slid under a door and the door is closed with the abutment on the internal side of the door, it would secure the receptacle to the external side of the door. The receptacle is left unlocked until a package is delivered and the delivery person pushes the lid down to lock it. The recipient can then retrieve the package with a key. This receptacle limits package delivery to one delivery until the owner unlocks it.

U.S. Pat. No. 10,398,246 to Crooks (2019) shows a package receptacle chute that would be installed into a wall, a door, or a garage and consists of a front panel with a handle that is connected to a floor panel at an obtuse angle and two opposing side panels all configured to form a pivoting package repository for securely receiving packages. This receptacle allows the interior of a home, garage, or building to be exposed when the chute is in the open position.

One advantage of this invention is that consumers can feel comfortable making online purchases knowing that their packages will be delivered to their address and not be left out in the open on a porch or entryway, but instead be inserted into a safe enclosed casing out of sight where it can be retrieved securely form inside a home or building. Also, the enclosed casing is sizable so that more than one package can be inserted, allowing for more than one delivery.

The simplicity of this invention makes it easy to use. The delivery person can easily access it and leave packages secured at the delivery address. Packages will sit in the enclosed casing to be safely and securely retrieved from the inside of a home or a building by the intended recipient.

SUMMARY OF INVENTION

The idea of this invention is to be a secure delivery method for packages while still serving as a safe and secure exterior door for a home or building. The main object of this invention is to put an end to packages being left exposed on porches and entryways and then being stolen.

This invention comprises a door with a built in constructed casing having an exterior front with an access tray with a handle that would be on the exterior side of a doorway, an interior back with an access door with a handle and a locking device that would be on the interior side of a doorway, which would be on the inside of a home or building, a casing top, opposing side panels, and a casing bottom that are all configured to define an enclosed space.

The access tray being connected to an inner tray flap with an assembled bracket system, wherein the inner tray flap is flat against the inner wall of the interior back casing. In operation, the handle of the access tray is pulled, setting the assembled bracket system in motion, which causes the inner tray flap to rise up to a 90 degree angle that is flush with the base of the access tray forming a flat surface inside the casing to place a package or packages. At least two pneumatic cylinders are attached on the right and left inner sides of the access tray and to the opposing interior side panels of the casing for a soft, smooth, and controlled opening and closing function. Once a package or packages have been placed onto the inner tray flap, releasing the access tray handle will close the access tray and further set the bracket system in motion causing the inner tray flap to lower back to its starting position, allowing the package or packages to be released to the secure enclosed casing bottom. Packages can then be retrieved by unlocking the access door located on the interior back of the casing and pulling the handle. The careful design of this invention provides a secure package delivery method that allows the recipient of a package to fully access their package or packages safely from within the confines of their home or building. It also allows the delivery person the ability to insert a package or packages into the casing without any exposure of the inside of the home or building or any access to the home or building. Further, with the configuration of the inner casing, the enclosed space is not visible from the exterior side when the access tray is in the open position.

BRIEF DESCRIPTION OF DRAWINGS

The following descriptions are made in reference to FIGS. 1-6 and are to be considered illustrations of the embodiment of the invention.

DETAILED DESCRIPTION OF INVENTION

The following descriptions are made in reference to FIGS. 1-6 and are provided as a written illustration of the embodiment of the present invention.

Figure 1:
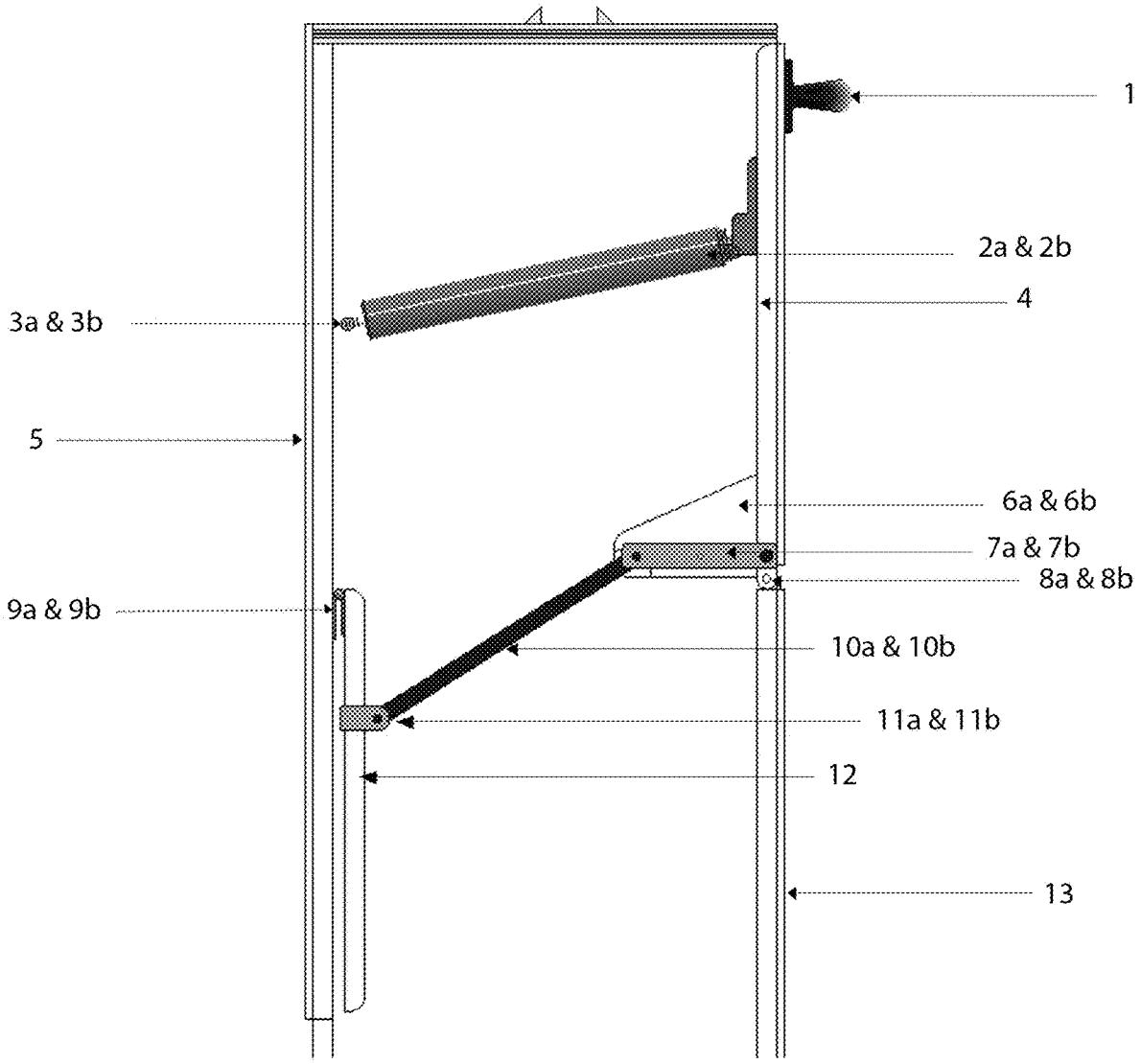
FIG. 1 illustrates a transparent side view of the constructed casing with the access tray being in the closed position

Referring to FIG. 1, being a transparent side view of the constructed casing in the closed position, can be seen to comprise exterior handle 1 that is affixed to and used to open access tray 4. Opposing rotating pins 8*a* and 8*b* are connected from opposing exterior side panels 15*a* and 15*b* of FIG. 3 to opposite sides of access tray 4 to form a pivoting motion when the access tray is being opened and closed. Opposing pneumatic cylinders 2*a* and 2*b* are connected from opposite sides of access tray 4 to opposing cylinder mounts 3*a* and 3*b*, which are affixed to opposing interior side panels 15*c* and 15*d* of FIG. 4. Inner tray flap 12 affixed to the inner side of the interior back casing 5 by flap hinges 9*a* and 9*b*. An assembled bracket system that consists of opposing support brackets 6*a* and 6*b* affixed to opposite bottom inner sides of access tray 4, opposing support connectors 7*a* and 7*b* connected from support brackets 6*a* and 6*b* to the bottom sides of access tray 4, opposing bracket connectors 10*a* and 10*b* extending from bracket supports 6*a* and 6*b* and support connectors 7*a* and 7*b* and connected to opposing flap connectors 11*a* and 11*b* which are affixed to opposite sides of tray flap 12. Interior back casing 5 is attached on opposite sides to interior side panels 15*c* and 15*d*, seen in FIG. 4, and to interior casing top 14*b*, seen in FIG. 4, and to casing bottom 16, seen in FIG. 4.

Figure 2:
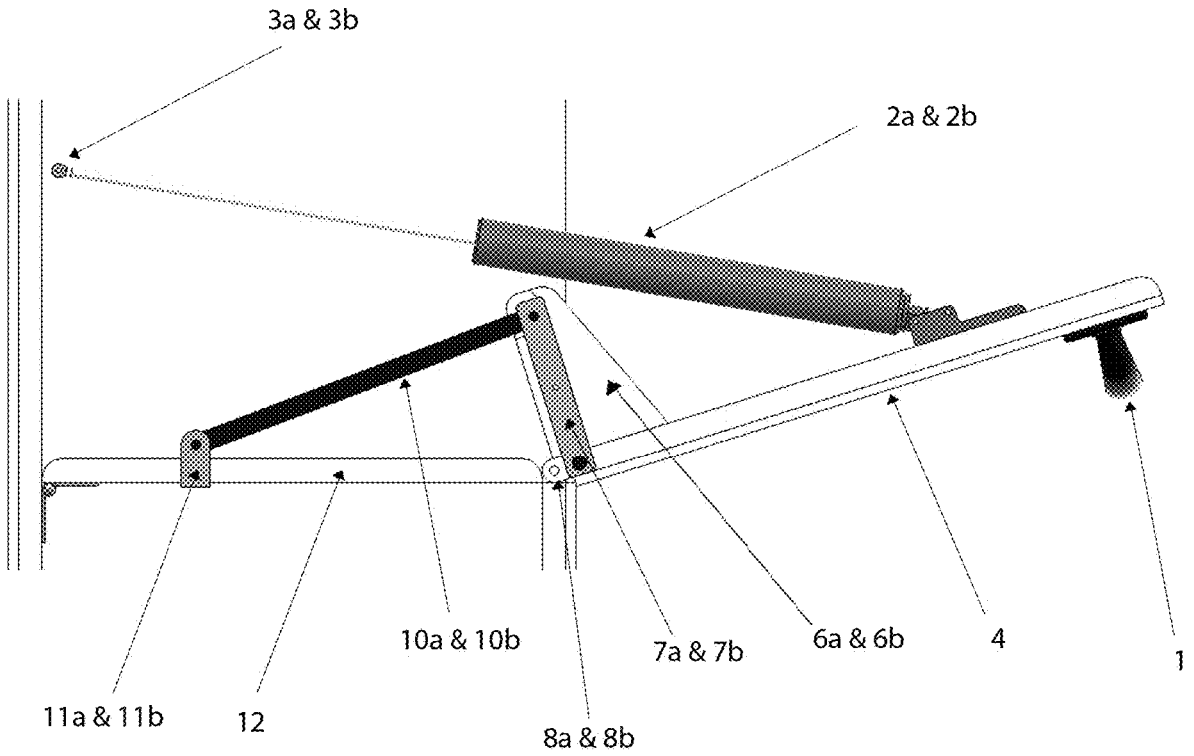
FIG. 2 illustrates a magnified transparent upper side view of the constructed casing with the access tray being in the open position.

Referring to FIG. 2, being a magnified transparent upper side view of the constructed casing in the open position, illustrating that when handle 1 is pulled open, access tray 4 pivots on rotating pins 8*a* and 8*b* and causes pneumatic cylinders 2*a* and 2*b* to extend out from the cylinder mounts 3*a* and 3*b*, also causing the assembled bracket system to be set in motion. Further, the opening motion of access tray 4 would cause bracket supports 6*a* and 6*b* and support connectors 7*a* and 7*b* to pull the bracket connectors 10*a* and 10*b* which in turn would pull the flap connectors 11*a* and 11*b* which would finally pull tray flap 12 up to a 90 degree angle, flush with the base of access tray 4. This flat surface would serve as a package receiving space and a package or packages would be placed here by a delivery person.

Further referring to FIG. 2, once the package or packages have been place on inner tray flap 12, the delivery person can then let go of access tray handle 1. This will again set the assembled bracket system in motion causing access tray 4 to close and inner tray flap 12 to return to its starting position of laying flat against the inner side of interior back casing 5, as seen in FIG. 1, and would release said package or packages to casing bottom 16 of FIG. 4 where the package or packages will be securely enclosed inside the constructed casing.

Figure 3:
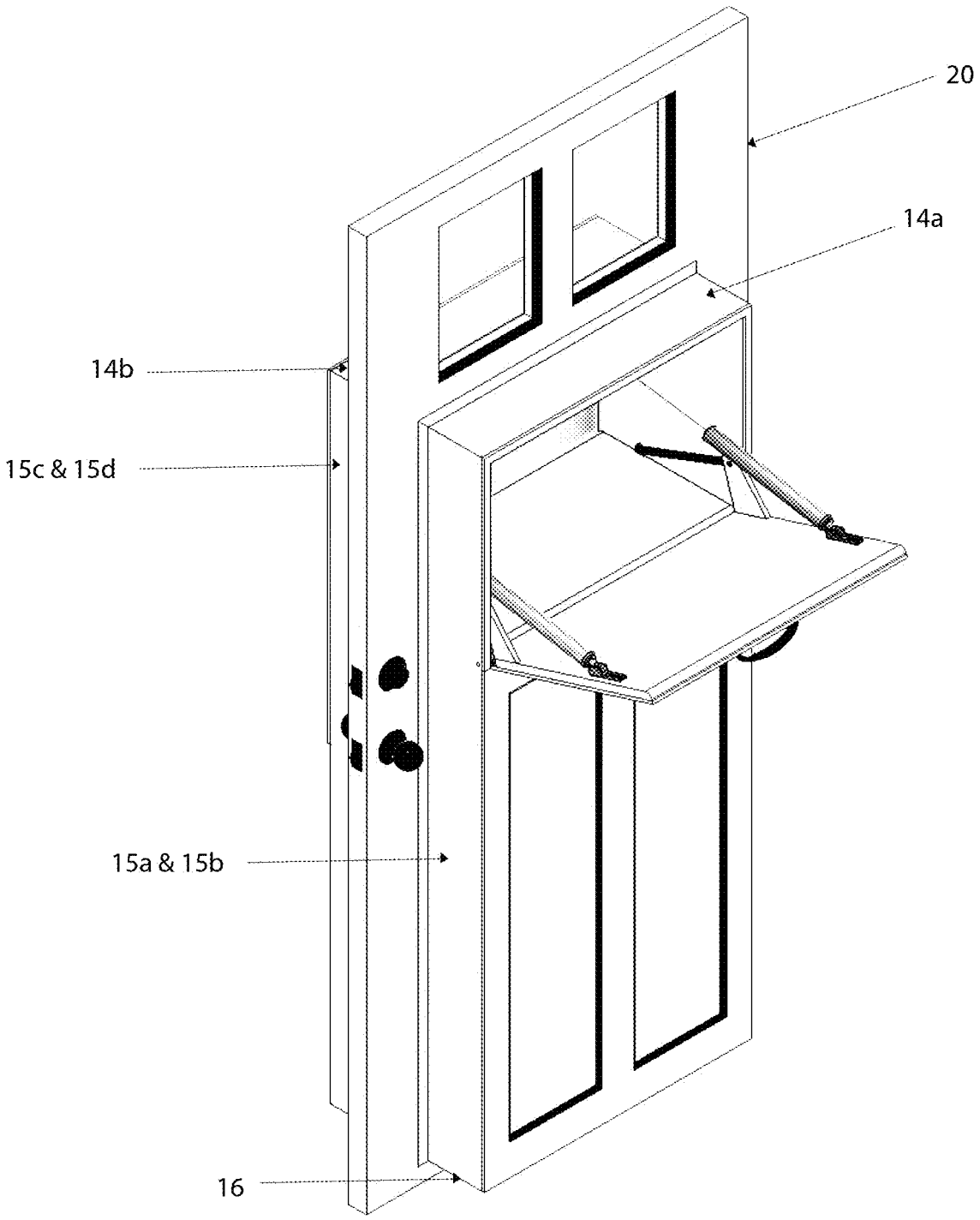
FIG. 3 illustrates a left-angled front view of the full exterior door with the constructed casing with the access tray being in the open position.

Referring to FIG. 3 being a left-angled front view of the fully constructed door with the access tray being in the open position. Exterior door 20 with decorative cut out windows, that embodies the constructed casing that is attached to exterior door 20 by exterior casing top 14*a*, interior casing top 14*b*, exterior side panels 15*a* and 15*b*, interior side panels 15*c* and 15*d*, and casing bottom 16.

Figure 4:
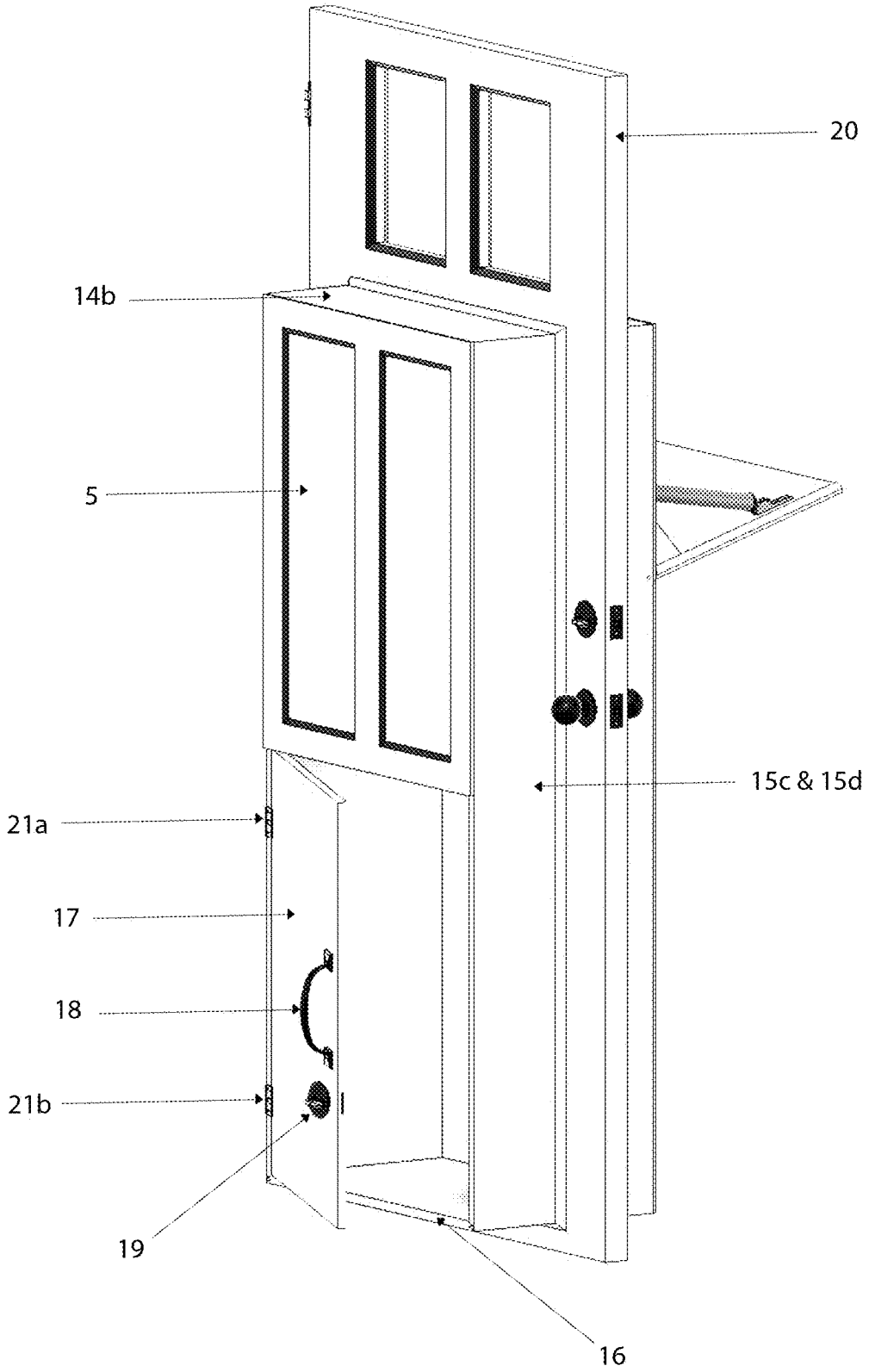
FIG. 4 illustrates a right-angled rear view of the full exterior door with the constructed casing with the access tray and access door both being in the open position.

Referring to FIG. 4 being a right-angled rear view of the fully constructed door with access door 17 in the open position. Access door handle 18 is affixed to access door 17 in a vertical position. Beneath handle 18 is a locking device 19 to secure the access door 17. Access door 17 is attached to interior side panel 15*c* with hinges 21*a* and 21*b*. Access door 17 and locking device 19 allow a package or packages to remain secure inside the constructed casing until the intended recipient unlocks and opens said access door 17.

Figure 5:
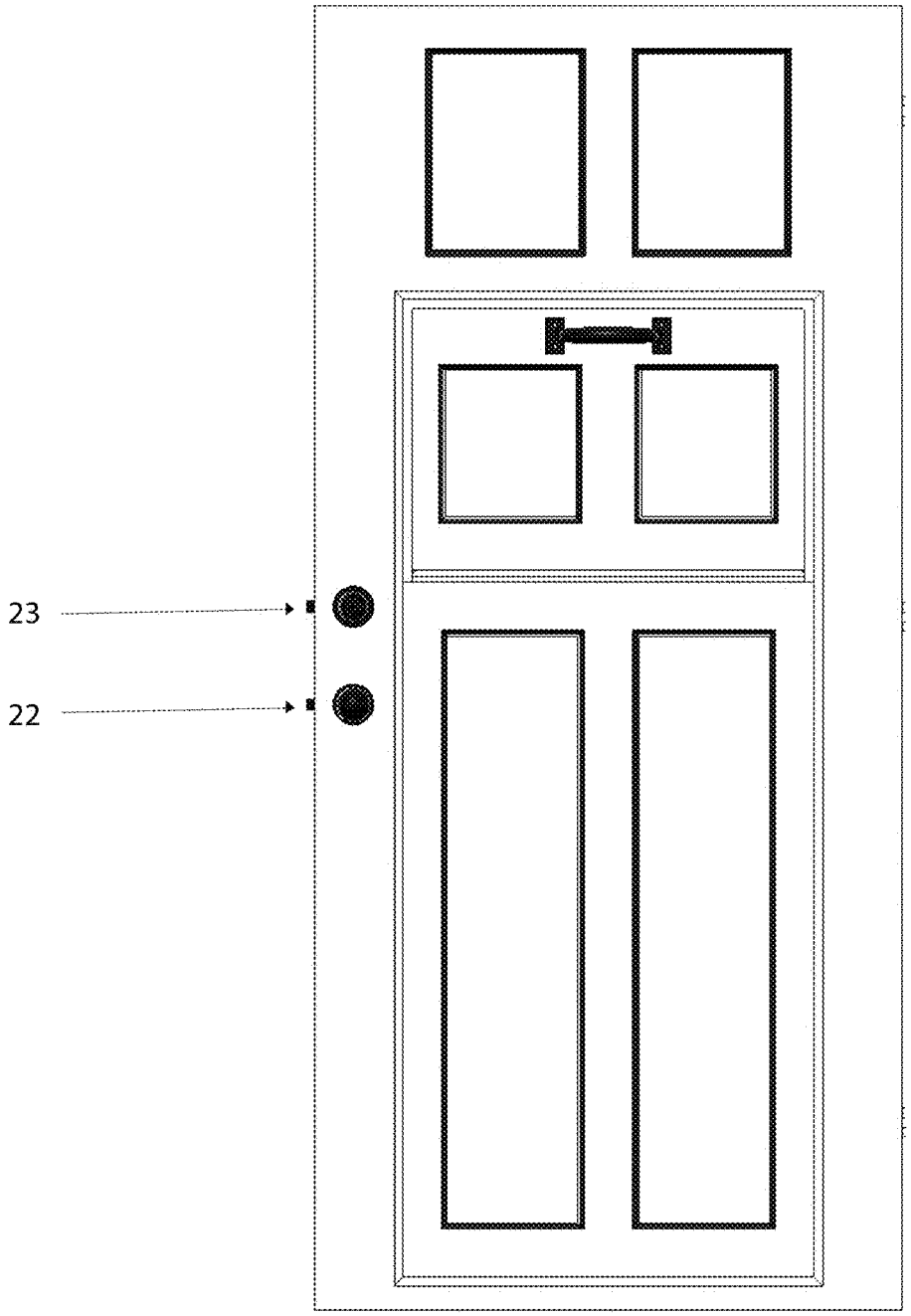
FIG. 5 illustrates a full front view of the exterior door with the constructed casing with the access tray being in the closed position.

Referring to FIG. 5 being a full frontal view of the exterior door with the constructed casing in the closed position in its completed form. Illustrating the door to be fully functional as a secure exterior door in an exterior doorway of a home or building with a doorknob 22 and a door lock 23.

Figure 6:
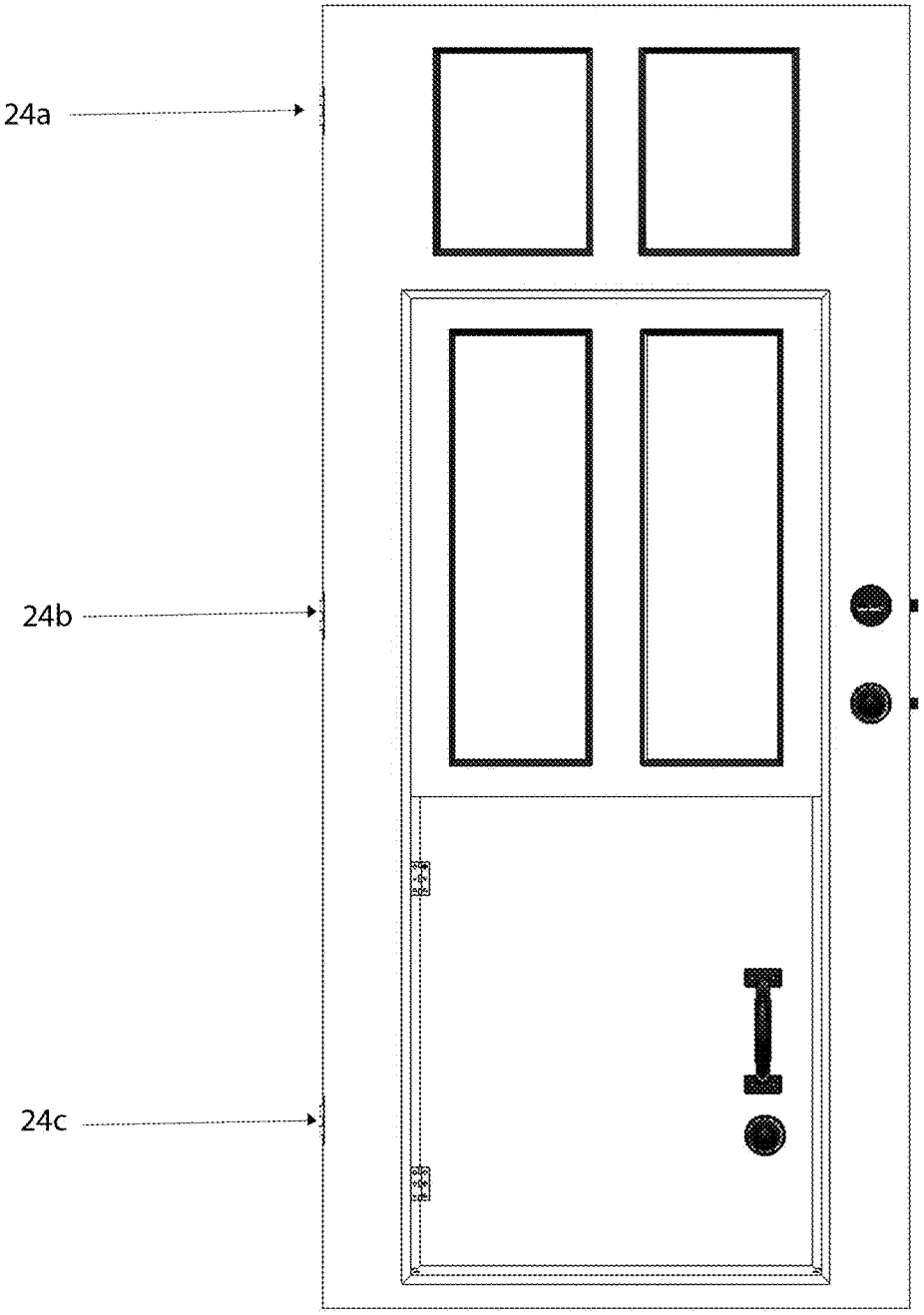
FIG. 6 illustrates a full rear view of the exterior door with the constructed casing with the access door being in the closed position.

Referring to FIG. 6, being a full rear view of the exterior door with the constructed casing in its completed form, illustrating the view of the interior side of the door from the inside of a home or building where the door would be attached to the door frame with hinges 24*a*, 24*b*, and 24*c*.

We claim the following:

1. A structured casing built within an exterior door in an exterior doorway, the casing comprising an exterior front casing with an access tray positioned on an exterior side of the doorway, further comprising an inner tray flap situated on the inside of an interior back casing, wherein the access tray and the inner tray flap are connected by an assembled bracket system, wherein the assembled bracket system comprises support brackets, support connectors, bracket connectors, and flap connectors, wherein the assembled bracket system comprises the interconnection of said assembled bracket system to the access tray and the inner tray flap, wherein the access tray is opened and the assembled bracket system is set in motion to pull the inner tray flap up to a 90-degree angle being positioned flush with the base of said access tray and forms a package receiving space, wherein an interior back casing with an access door positioned on an interior side of the doorway, an interior and exterior casing top, opposing interior and exterior side panels, and a casing bottom that when combined define an enclosed space for securely holding received packages.

2. The structured casing of claim 1 wherein the structured casing is built within the exterior door of the exterior doorway of a home or building.

3. The structured casing of claim 1 wherein the access tray includes a handle for opening said access tray and placing a package or packages inside the casing.

4. The structured casing of claim 1 wherein the access tray comprises at least two rotating pin attachments that are further attached to the exterior opposing side panels, that when opening and closing of said access tray, form a pivoting motion.

5. The structured casing of claim 1 wherein the opposing interior side panels comprise at least one cylinder mount on each panel.

6. The structured casing of claim 1 wherein the access tray comprises at least two pneumatic cylinders mounted on one end to the inner sides of the access tray for soft, smooth, and controlled opening and closing of said access tray.

7. The structured casing of claim 1 wherein the inner tray flap comprising at least two hinge attachments affixed to the inner side of the interior back casing.

8. The structured casing of claim 1 wherein the assembled bracket system is activated by the motion of opening and closing the access tray.

9. The structured casing of claim 1 wherein the access tray is closed and said assembled bracket system is set in motion causing the inner tray flap to return to its starting position and the package or packages to release to the casing bottom.

10. The structured casing of claim 1 wherein the access door is attached to the interior side panel by at least two hinges.

11. The structured casing of claim 10 wherein the access door includes a handle for opening to retrieve a package or packages and for closing said access door.

12. The structured casing of claim 10 wherein the access door includes a locking device to secure said access door.

* * * * *